US010870532B2

(12) United States Patent
Chang et al.

(10) Patent No.: US 10,870,532 B2
(45) Date of Patent: Dec. 22, 2020

(54) MOVABLE EQUIPMENT LOADING AND UNLOADING STRUCTURE

(71) Applicant: HONGFUJIN PRECISION ELECTRONICS (TIANJIN) CO., LTD., Tianjin (CN)

(72) Inventors: Chih-Hung Chang, New Taipei (TW); Yen-Chun Fu, New Taipei (TW); Tze-Chern Mao, New Taipei (TW); Chao-Ke Wei, New Taipei (TW)

(73) Assignee: HONGFUJIN PRECISION ELECTRONICS (TIANJIN) CO., LTD., Tianjin (CN)

( * ) Notice: Subject to any disclaimer, the term of this patent is extended or adjusted under 35 U.S.C. 154(b) by 103 days.

(21) Appl. No.: 16/179,442

(22) Filed: Nov. 2, 2018

(65) Prior Publication Data

US 2020/0071066 A1 Mar. 5, 2020

(30) Foreign Application Priority Data

Aug. 31, 2018 (CN) ..... 2018 1 1015337

(51) Int. Cl.

| | |
|---|---|
| ***B60P 7/08*** | (2006.01) |
| ***B65D 88/12*** | (2006.01) |
| ***B65D 88/00*** | (2006.01) |
| ***B65D 88/02*** | (2006.01) |
| ***B65D 90/00*** | (2006.01) |

(52) U.S. Cl.

CPC ..... *B65D 88/129* (2013.01); *B65D 88/005* (2013.01); *B65D 88/027* (2013.01); *B65D 90/004* (2013.01); *B65D 90/006* (2013.01); *B65D 90/0053* (2013.01); *B65D 90/0073* (2013.01)

(58) Field of Classification Search

CPC .. B65D 88/027; B65D 88/005; B65D 88/546; B65D 88/129; B65D 90/004; B65D 90/046; B65D 90/0053; B65D 90/006; B65D 90/0073; B65D 88/127

USPC ..... 410/66, 67; 220/23.88; 414/498

See application file for complete search history.

(56) References Cited

U.S. PATENT DOCUMENTS

| | | | | |
|---|---|---|---|---|
| 2,752,864 A * | 7/1956 | McDougal, Sr. .... | B61D 45/006 410/130 |
| 5,562,374 A * | 10/1996 | Plamper ..... | B61D 1/06 410/66 |
| 9,296,554 B2 * | 3/2016 | Ferren ..... | B65D 88/121 |

FOREIGN PATENT DOCUMENTS

| | | |
|---|---|---|
| CN | 201458549 U | 5/2010 |
| CN | 202767812 U | 3/2013 |
| CN | 105704971 A | 6/2016 |

* cited by examiner

*Primary Examiner* — Stephen T Gordon

(74) *Attorney, Agent, or Firm* — ScienBiziP, P.C.

(57) ABSTRACT

A movable equipment loading and unloading structure for movably mounting equipment within a container includes a loading and unloading assembly and a guide assembly. The loading and unloading assembly includes a loading and unloading rail mounted to a ceiling of the container and a loading and unloading wheel assembly movably coupled to the loading and unloading rail. The loading and unloading wheel assembly is mounted to a side of the equipment. The guide assembly includes a guide rail mounted to a floor of the container and at least one guide wheel rollably coupled to the guide rail. The guide wheel is mounted to another side of the equipment opposite to the side mounted to the loading and unloading wheel assembly.

16 Claims, 4 Drawing Sheets

MOVABLE EQUIPMENT LOADING AND UNLOADING STRUCTURE

FIELD

The subject matter herein generally relates to movable containers, and more particularly to a container including a movable equipment loading and unloading structure for mounting equipment within the container.

BACKGROUND

Containers, such as shipping containers, are often required to have large equipment, such as an air conditioner, for cooling the container. The equipment is generally heavy and of a large size.

Therefore, there is room for improvement within the art.

BRIEF DESCRIPTION OF THE DRAWINGS

Implementations of the present disclosure will now be described, by way of example only, with reference to the attached figures.

DETAILED DESCRIPTION

Figure 1:
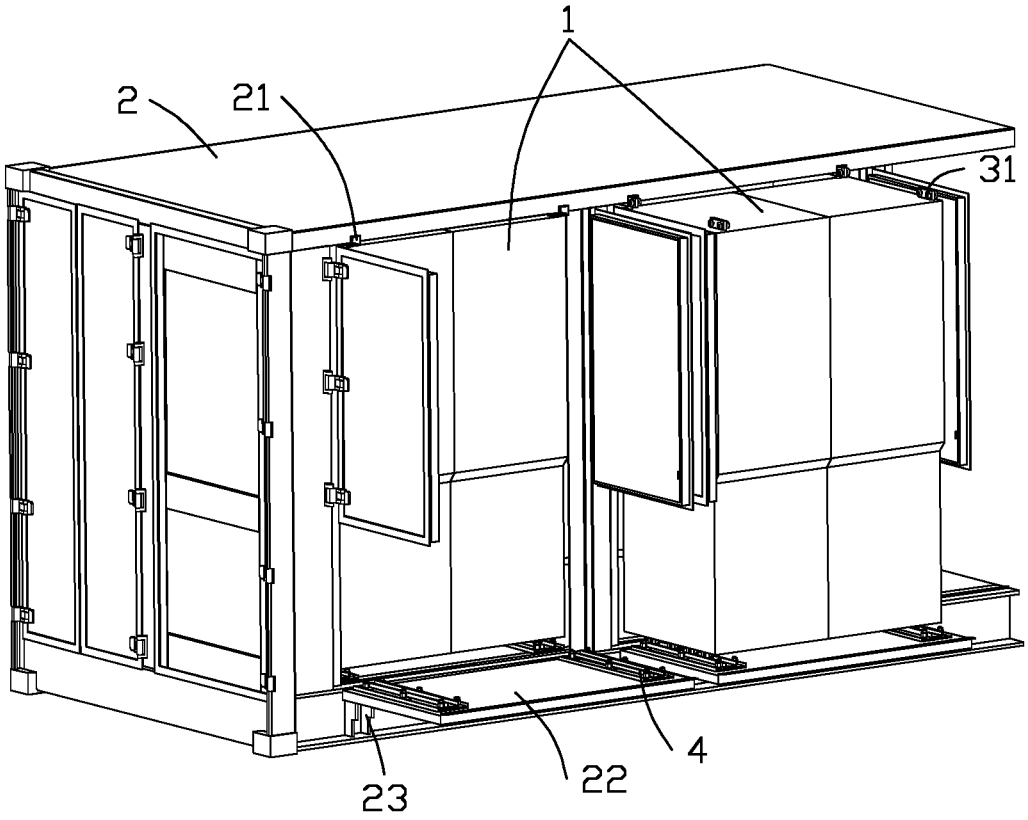
FIG. 1 is an assembled, isometric view of a container including a movable equipment loading and unloading structure in accordance with an embodiment of the disclosure.

It will be appreciated that for simplicity and clarity of illustration, where appropriate, reference numerals have been repeated among the different figures to indicate corresponding or analogous elements. Additionally, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape, or other word that "substantially" modifies, such that the component need not be exact. For example, "substantially cylindrical" means that the object resembles a cylinder, but can have one or more deviations from a true cylinder. The term "comprising" means "including, but not necessarily limited to"; it specifically indicates open-ended inclusion or membership in a so-described combination, group, series and the like.

FIG. 1 shows an embodiment of a movable equipment loading and unloading structure for movably mounting equipment 1 within a container 2. The equipment 1 is large equipment, such as an air conditioning unit. The movable equipment loading and unloading structure allows for convenient loading and unloading and removal of the equipment 1 within the container 2. In one embodiment, the movable equipment loading and unloading structure includes a plurality of loading and unloading assemblies 3 (shown in FIG. 2) and a plurality of guide assemblies 4. The loading and unloading assembly 3 is mounted on a top of the equipment 1, and the guide assembly 4 is mounted on a bottom of the equipment 1.

Figure 2:
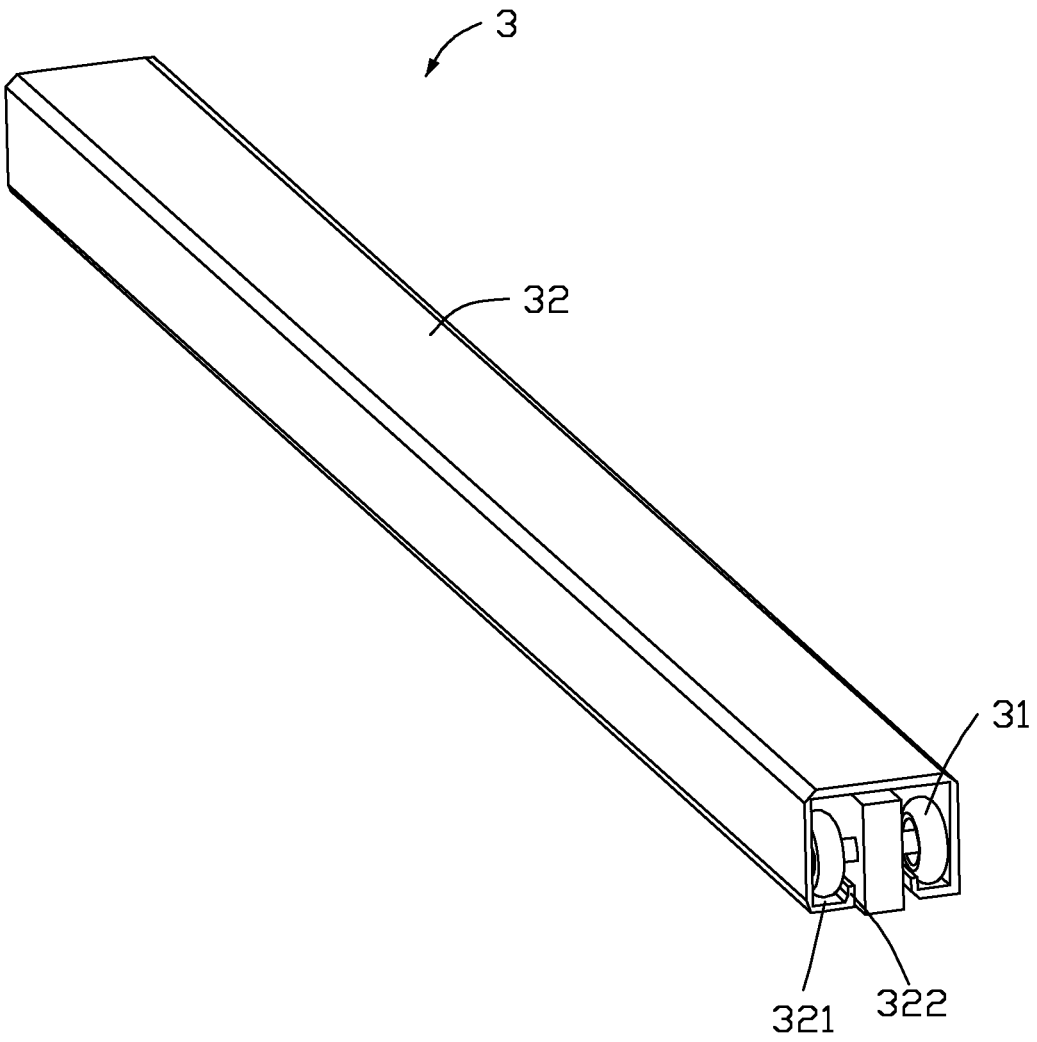
FIG. 2 is an isometric view of a loading and unloading assembly of the movable equipment loading and unloading structure.

FIG. 2 shows the loading and unloading assembly 3 including a loading and unloading wheel assembly 31 and a loading and unloading rail 32. The loading and unloading wheel assembly 31 is received within the loading and unloading rail 32. The loading and unloading wheel assembly 31 is rollably coupled to the loading and unloading rail 32 and is configured to roll along the inside of the loading and unloading rail 32. The container 2 defines a plurality of through holes 21 (shown in FIG. 1) in a top sidewall thereof. The loading and unloading rail 32 is received within a corresponding one of the through holes 21, and an upper surface of the loading and unloading rail 32 is mounted to a ceiling of the container 2. The loading and unloading wheel assembly 31 is able to roll out of or roll into the loading and unloading rail 32 through the through hole 21.

Figure 4:
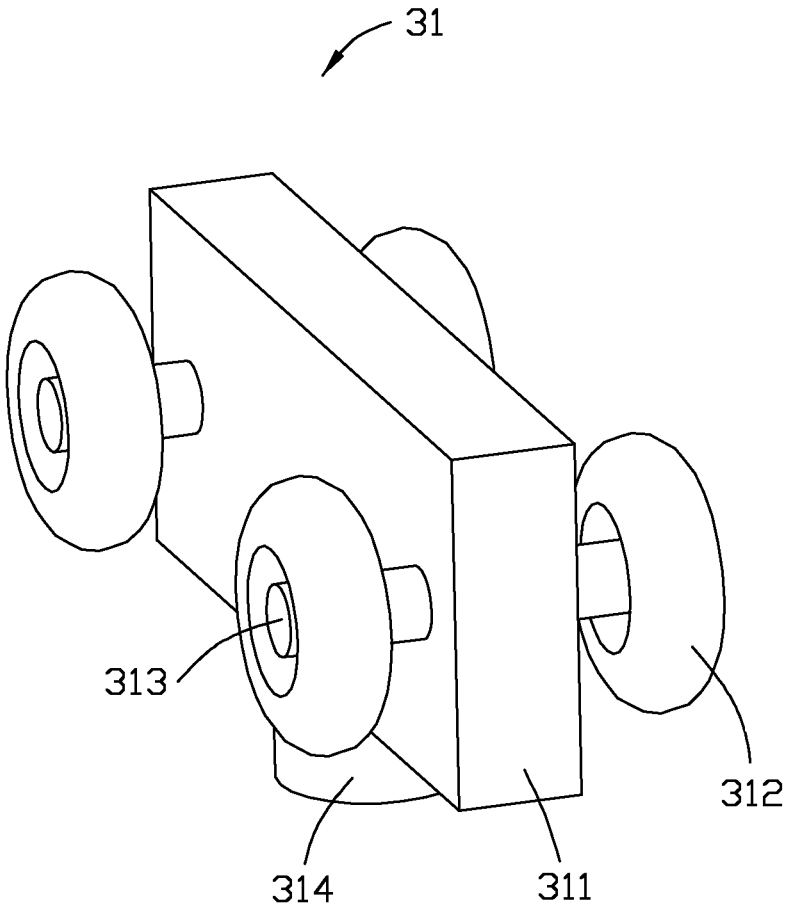
FIG. 4 is an isometric view of a loading and unloading wheel assembly of the loading and unloading assembly in FIG. 2.

FIG. 4 shows the loading and unloading wheel assembly 31 including a connector 311, a plurality of wheels 312, and a plurality of wheel shafts 313. Each wheel shaft 313 extends through the connector 311 and is mounted to the connector 311. Each of two ends of the wheel shaft 313 has a corresponding wheel 312 rotationally mounted thereon, so that one wheel 312 of a pair of wheels is mounted on one side of the connector 311, and a second wheel 312 of the pair of wheels is mounted on the other side of the connector 311. A connecting portion 314 is coupled to a bottom of the connector 311 to mount the connector 311 to a top of the equipment 1.

FIG. 2 shows the loading and unloading rail 32 including a top plate (not labeled) and two side plates (not labeled) each coupled substantially perpendicularly to the top plate. A bottom of each side plate is coupled to a supporting portion 321 extending substantially perpendicularly from the side plate. The wheels 312 roll on the supporting portions 321. The connector 311 is positioned between the two supporting portions 321. An edge of each supporting portion 321 away from the corresponding sidewall extends upward to form a limiting portion 322. Each sidewall of the loading and unloading rail 32 and the corresponding limiting portion 322 cooperatively define a guide channel (not labeled). The loading and unloading wheel assembly is received in the guide channel. The wheels 312 roll along the guide channel. In one embodiment, the equipment 1 is mounted to two corresponding loading and unloading rails 32. Each guiding rail 32 receives two loading and unloading wheel assemblies 31. The rolling assemblies 31 are arranged at four corners of the equipment 1. In other embodiments, quantities of the loading and unloading rail 32 and the loading and unloading wheel assembly 31 may be adjusted according to loading requirements.

FIG. 1 shows the container 2 including a rotating floor 22. The rotating floor 22 is rotationally coupled to a bottom of the container 2. The container 2 includes a limiting member 23 positioned below the rotating floor 22 to limit rotation of the rotating floor 22 and support the rotating floor 22 to prevent strain of the rotating floor 22 by weight of the equipment 1. The guide assembly 4 is mounted on top of the rotating floor 22.

Figure 3:
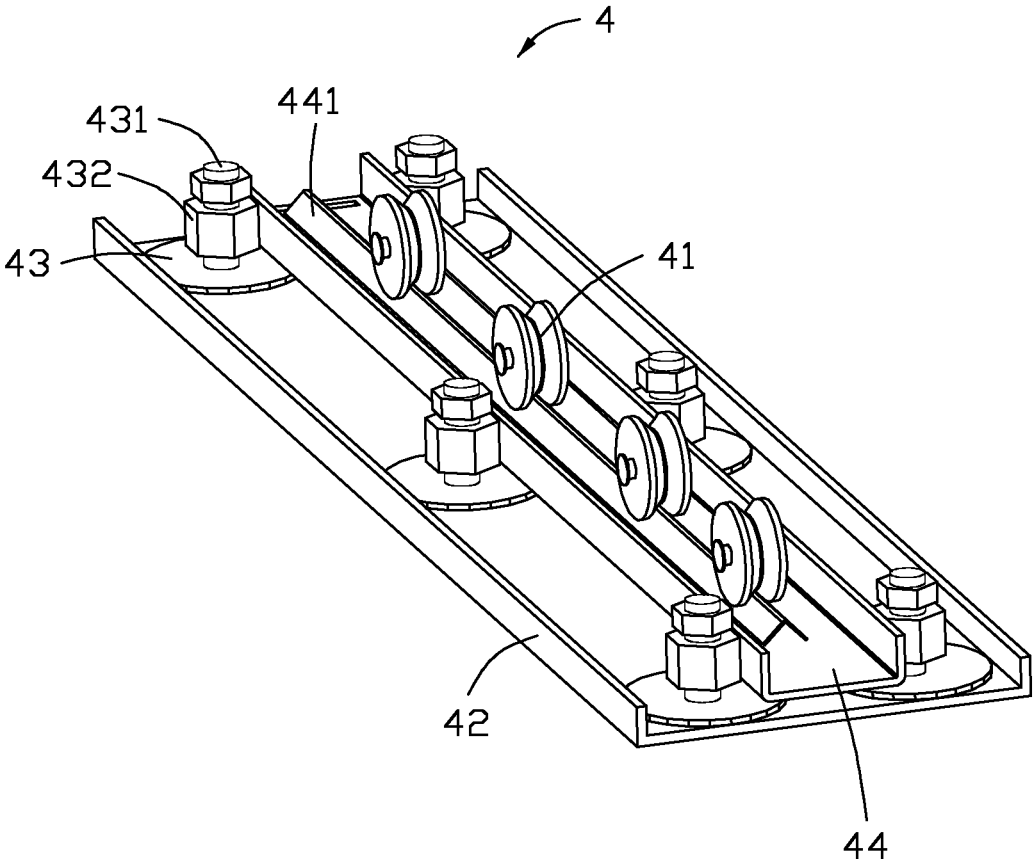
FIG. 3 is an isometric view of a guide assembly of the movable equipment loading and unloading structure.

FIG. 3 shows the guide assembly 4 including a guide wheel 41, a mounting base 42, a rail mounting member 43, and a guide rail 44. The mounting base 42 is mounted either on the bottom of the container 2 within the container 2 or on the rotating floor 22. The guide rail 44 is mounted in a central area of the mounting base 42. A plurality of rail mounting members 43 are arranged on opposite sides of the guide rail 44. The rail mounting members 43 abut the guide rail 44 and a side of the mounting base 42, thereby mounting the guide rail 44 to the mounting base 42. In detail, a base of the rail mounting member 43 abuts an inner sidewall of the mounting base 42. The rail mounting member 43 includes a central shaft 431, and a mounting ring 432 is sleeved over the central shaft 431 and abuts an outer sidewall of the guide rail 44. In one embodiment, the mounting ring 432 is a hexagonal nut. The hexagonal nut is tightened or loosened over the central shaft 431 to adjust a holding force on the guide rail 44. Compared to using screws to screws the guide rail 44 directly to the mounting base 42, the mounting ring 432 is more convenient for mounting the guide rail 44 and avoids needing to drill holes in the guide rail 44, thereby avoiding concentration of stress on the guide rail 44. The guide rail 44 includes a positioning unit 441. An outer surface of the guide wheels 41 mesh with the positioning unit 441 to rotationally couple to a bottom of the equipment 1. Thus, the guide wheels 41 are able to roll along the positioning unit 441 to roll the equipment 1 along the guide rail 44. In one embodiment, the bottom of the equipment is mounted to two guide assemblies 4. In other embodiments, a quantity of the guide assembly 4 may be changed according to loading requirements.

When the equipment 1 needs to be unloaded from the container 2, a side door of the container 2 is opened, the rotating floor 22 is rotated to be level with the bottom of the container 2, and the equipment 1 is pulled out. The loading and unloading wheel assembly 31 rolls along the loading and unloading rail 32, and the guide wheels 41 on the bottom of the equipment 1 roll along the guide rails 44. Thus, the equipment 1 is unloaded from the container 2 over the rotating floor 22.

The movable equipment loading and unloading structure uses the loading and unloading assembly 3 and the guide assembly 4 to reduce friction between the equipment 1 and the container 2 when rolling out the equipment 1 from the container 2. The equipment 1 is loaded into the container 2 by the loading and unloading assembly 3 and the guide assembly 4. The movable equipment loading and unloading structure has a simple structure and is operable by a single user.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. A movable equipment loading and unloading structure configured to movably mount equipment within a container, the movable equipment loading and unloading structure comprising:

a loading and unloading assembly comprising:

a loading and unloading rail mounted to a ceiling of the container; and a loading and unloading wheel assembly movably coupled to the loading and unloading rail, the loading and unloading wheel assembly mounted to a side of the equipment; and a guide assembly comprising:

a mounting base mounted on a bottom of the container;

a guide rail mounted within the mounting base;

a plurality of rail mounting members mounted on opposite sides of the guide rail, each of the plurality of mounting members abutting the guide rail and the mounting base to mount the guide rail to the mounting base; and at least one guide wheel rollably coupled to the guide rail, the guide wheel mounted to another side of the equipment opposite to the side mounted to the loading and unloading wheel assembly.

2. The movable equipment loading and unloading structure of claim 1, wherein the loading and unloading rail comprises a supporting portion coupled perpendicularly to a sidewall of the loading and unloading rail; the loading and unloading wheel assembly is rollably coupled to the supporting portion.

3. The movable equipment loading and unloading structure of claim 2, wherein the supporting portion comprises a limiting portion; the limiting portion is a side edge of the supporting portion extending upward opposite to the sidewall of the loading and unloading rail; the limiting portion and the sidewall of the loading and unloading rail limit the loading and unloading wheel assembly to roll therebetween.

4. The movable equipment loading and unloading structure of claim 3, wherein the loading and unloading wheel assembly comprises:

a connector, a bottom of the connector mounted to the equipment;

a wheel shaft coupled to the connector; and a wheel coupled to an end of the wheel shaft and rollably coupled to the loading and unloading rail.

5. The movable equipment loading and unloading structure of claim 1, wherein the container comprises a rotating floor; one end of the rotating floor is rotationally coupled to a bottom of the container; the mounting base is mounted on the container and the rotating floor.

6. The movable equipment loading and unloading structure of claim 5, further comprising a limiting member coupled to the bottom of the container; the limiting member limits rotation of the rotating floor and supports the rotating floor.

7. The movable equipment loading and unloading structure of claim 1, wherein each of the plurality of rail mounting members comprises a central shaft and a mounting ring; the mounting ring is sleeved over the central shaft; a bottom of the rail mounting member abuts an inner surface of the mounting base; the mounting ring abuts an outer surface of the guide rail.

8. The movable equipment loading and unloading structure of claim 1, wherein the guide rail comprises a positioning unit; the guide wheel meshes with the positioning unit and is rollably coupled to the positioning unit.

9. A movable receptacle comprising a container and a movable equipment loading and unloading structure, the movable equipment loading and unloading structure received within the container and configured to movably hang equipment within the container, the movable equipment loading and unloading structure comprising:

a loading and unloading assembly comprising:

a loading and unloading rail mounted to a ceiling of the container; and a loading and unloading wheel assembly movably coupled to the loading and unloading rail, the loading and unloading wheel assembly mounted to a side of the equipment; and a guide assembly comprising:

a mounting base mounted on a bottom of the container;

a guide rail mounted within the mounting base;

a plurality of rail mounting members mounted on opposite sides of the guide rail, each of the plurality of mounting members abutting the guide rail and the mounting base to mount the guide rail to the mounting base; and at least one guide wheel rollably coupled to the guide rail, the guide wheel mounted to another side of the equipment opposite to the side mounted to the loading and unloading wheel assembly.

10. The movable receptacle of claim 9, wherein the loading and unloading rail comprises a supporting portion coupled perpendicularly to a sidewall of the loading and unloading rail; the loading and unloading wheel assembly is rollably coupled to the supporting portion.

11. The movable receptacle of claim 10, wherein the supporting portion comprises a limiting portion; the limiting portion is a side edge of the supporting portion extending upward opposite to the sidewall of the loading and unloading rail; the limiting portion and the sidewall of the loading and unloading rail limit the loading and unloading wheel assembly to roll therebetween.

12. The movable receptacle of claim 11, wherein the loading and unloading wheel assembly comprises:

a connector, a bottom of the connector mounted to the equipment;

a wheel shaft coupled to the connector; and a wheel coupled to an end of the wheel shaft and rollably coupled to the loading and unloading rail.

13. The movable receptacle of claim 9, wherein the container comprises a rotating floor; one end of the rotating floor is rotationally coupled to the bottom of the container; the mounting base mounted on the container and the rotating floor.

14. The movable receptacle of claim 13, wherein the movable equipment loading and unloading structure further comprises a limiting member coupled to the bottom of the container; the limiting member limits rotation of the rotating floor and supports the rotating floor.

15. The movable receptacle of claim 9, wherein each of the plurality of rail mounting members comprises a central shaft and a mounting ring; the mounting ring is sleeved over the central shaft; a bottom of the rail mounting member abuts an inner surface of the mounting base; the mounting ring abuts an outer surface of the guide rail.

16. The movable receptacle of claim 9, wherein the guide rail comprises a positioning unit; the guide wheel meshes with the positioning unit and is rollably coupled to the positioning unit.

* * * * *